US006419167B1

(12) United States Patent
Fuchs

(10) Patent No.: US 6,419,167 B1
(45) Date of Patent: Jul. 16, 2002

(54) DISPENSER FOR FLOWABLE MEDIA, PARTICULARLY FOR ATOMIZING LIQUIDS

(75) Inventor: Karl-Heinz Fuchs, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 3 days.

(21) Appl. No.: 09/631,812

(22) Filed: Aug. 3, 2000

(30) Foreign Application Priority Data

Aug. 7, 1999 (DE) ..... 199 37 442

(51) Int. Cl.[7] ..... B05B 11/02

(52) U.S. Cl. ..... 239/323; 239/327; 239/329; 239/463; 239/489; 239/493; 222/94; 222/389

(58) Field of Search ..... 239/320, 322, 239/323, 327, 329, 338, 463, 487, 489, 493; 222/92, 94, 107, 386, 389, 153.06, 153.07, 541.6

(56) References Cited

U.S. PATENT DOCUMENTS

| | | | | |
|---|---|---|---|---|
| 3,085,753 A | | 4/1963 | Braun et al. | |
| 3,184,120 A | | 5/1965 | Undi | |
| 3,201,003 A | | 8/1965 | Wark et al. | |
| RE29,176 E | * | 4/1977 | Loeffler | 239/322 X |
| 4,067,499 A | * | 1/1978 | Cohen | 239/323 |
| 4,344,573 A | | 8/1982 | De Felice | |
| 4,603,794 A | * | 8/1986 | DeFord et al. | 239/327 X |
| 4,972,977 A | * | 11/1990 | Moss et al. | 239/327 X |
| 5,289,948 A | | 3/1994 | Moss et al. | |
| 5,409,125 A | * | 4/1995 | Kimber et al. | 222/541.6 X |
| 5,511,698 A | * | 4/1996 | Solignac | 222/386 X |
| 5,678,736 A | | 10/1997 | Hansen | |

FOREIGN PATENT DOCUMENTS

| | | |
|---|---|---|
| DE | 8222355 | 11/1982 |
| DE | 8220965 | 7/1983 |
| DE | 4308397 | 1/1994 |
| DE | 4420594 | 12/1995 |
| DE | 44 23 261 A1 | 1/1996 |
| EP | 00 11 5798 | 1/2002 |

* cited by examiner

*Primary Examiner*—Steven J. Ganey
(74) *Attorney, Agent, or Firm*—Quarles & Brady LLP

(57) ABSTRACT

A dispenser (11) with an atomizing nozzle (15) contains a medium chamber (20) with the medium (24) to be discharged. The pump plunger (21) delivering the medium (24) is hydraulically operated by the pressure of a pressure fluid (25), which is manually applied by pressure on a pressure chamber (28) constructed as a squeezing bottle or bag. Several dispensers can be jointly manufactured and sold in chain form.

16 Claims, 2 Drawing Sheets

DISPENSER FOR FLOWABLE MEDIA, PARTICULARLY FOR ATOMIZING LIQUIDS

FIELD OF USE AND PRIOR ART

For the discharge of media, particularly pharmaceutical or cosmetic products, numerous types of dispensers have been developed, e.g. atomizers or sprayers. They normally operate with manual drive for a pump plunger or piston, which places the medium under the pressure necessary for discharge purposes. Particularly for very expensive pharmaceuticals which have to be very accurately dosed disposable dosing means have been developed, in which the container for the medium is simultaneously the pump chamber and container closure of the pump plunger. Such an atomizer is known from DE-A-44 12 041. For manual drive purposes the medium container is received in a jacket on which the user presses and directly mechanically moves the pump plunger.

The cooperation of the manual drive with the specific discharge function, e.g. an atomization, is not ensured under all circumstances. It is consequently necessary to ensure that the user acts with a relatively uniform pressure over the entire plunger stroke in order to ensure a reliable, uniform atomization. Particularly for such disposable dosing means, it would also be appropriate to reduce the number of moving parts and their manufacturing requirements.

For the discharge of pasty products, e.g. toothpaste, it is known to use containers with a separating plunger running therein (DE 44 20 594 A; DE 82 22 355 U; U.S. Pat. No. 3,184,120 A; DE 43 08 397 A; DE 82 20 965 U). They are partly driven by air pressure.

OBJECT AND SOLUTION

Thus, the object of the invention is to provide a dispenser for flowable media, particularly for atomizing liquids which, in the case of simple construction and operation, creates the prerequisites for a uniform medium discharge. On the medium chamber simultaneously forming the pump chamber it can have a partly compressible pressure chamber, which is filled with a pressure fluid, preferably a liquid, e.g. water and which simultaneously places under pressure the pump plunger serving as the medium chamber closure.

As a certain minimum pressure is necessary for effective atomization, it must be ensured that this is maintained from the start to the finish of the discharge process. For this purpose in the inoperative state the plunger can have a predetermined restraint, which must be overcome in order to move the plunger, whilst the running resistance for continuing the discharge process can be reduced. This can be brought about by a corresponding choice of materials for the plunger and medium chamber wall, as well as the pressure between the plunger and medium chamber wall. However, it is also possible to incorporate certain mechanical restraints, e.g. a circumferential rib in the medium chamber wall, a snap action device, etc.

Apart from liquids, the pressure fluid can be constituted by other flowable media, e.g. gases such as air and which as a result of their compressibility do not permit such a direct transfer of forces as liquids, but as a result of said compressibility form a hydraulic accumulator which, after overcoming the static friction of the plunger, ensure a complete and speedy performance of the stroke, i.e. a pressure point function in the manner described hereinbefore.

For the operation of the dispenser the invention makes it possible to effect a hydraulic transmission. For this purpose the plunger has different active surfaces for the medium and pressure chambers. With a relatively low pressure in the pressure chamber it is possible to produce a correspondingly higher pressure in the medium chamber.

In order to ensure an adequate initial pressure the pressure chamber can have a manually operable snap action device. It is possible, e.g. through the curvature of the wall of the pressure chamber, to obtain the action of a "snap catch". This can be used for producing a very brief, sudden discharge process. It is also possible to select the pressure fluid as a combination of compressible and incompressible media, in that e.g. a certain gas volume (air pocket) is incorporated into a liquid. If e.g. as a result of a "snap catch action" a sudden pressure build-up is obtained in the pressure chamber, this can be substantially maintained over the in some cases somewhat longer discharge stroke.

The pressure chamber can be constructed in the manner of a squeezing container and is preferably directly connected to the medium chamber. It is e.g. possible to construct the medium chamber as a somewhat thicker walled cylinder and to connect to it a thinner walled jacket as the pressure chamber and which after filling the medium chamber with the medium to be discharged, inserting the plunger and filling the pressure chamber with the pressure fluid is sealed e.g. by a weld. As a result the dispenser can be made from a very few parts, namely a base part forming the medium and pressure chambers, the plunger and optionally an insert in the medium chamber, which cooperates with the outlet port for forming an atomizing nozzle.

It is advantageous to manufacture the base part by two-component injection moulding, in which simultaneously or successively different plastics or plastic variants for different areas of the shaped body are injected into the injection mould. Thus, the cylinder section can comprise a more rigid and more shape-stable plastic, whereas a softer, more flexible plastic is chosen for the pressure chamber section. Advantageously both should be of the same plastic type, but with a different hardness setting, in order to permit type-pure disposal. This is always possible in the case of the invention due to the lack of other materials such as metals or the like.

The discharge port can be closed by valves, which can be either pressure-operated or path-operated. However, it is adequate for disposable dosing means to close or seal the discharge port, which can simultaneously form an atomizing nozzle, with a break-off closure.

It is consequently possible to manufacture a dispenser having a very simple construction. It is even possible to manufacture it in the form of a strip of several continuous dispensers, which are interconnected by means of a predetermined breaking point at their base parts. This facilitates not only manufacture and transportation in the filling means, but also makes it possible to pack together several pharmaceutical charges, from which an individual charge can then be broken off.

These and other features can be gathered from the claims, description and drawings and the individual features, both singly and in the form of subcombinations, can be implemented in an embodiment of the invention and in other fields and can represent advantageous, independently protectable constructions for which protection is hereby claimed. The subdivision of the application into individual sections and the subtitles in no way restrict the general validity of the statements made thereunder.

BRIEF DESCRIPTION OF THE DRAWINGS

An embodiment of the invention is described in greater detail hereinafter relative to the attached drawings, wherein show.

DESCRIPTION OF A PREFERRED EMBODIMENT

Figure 1:
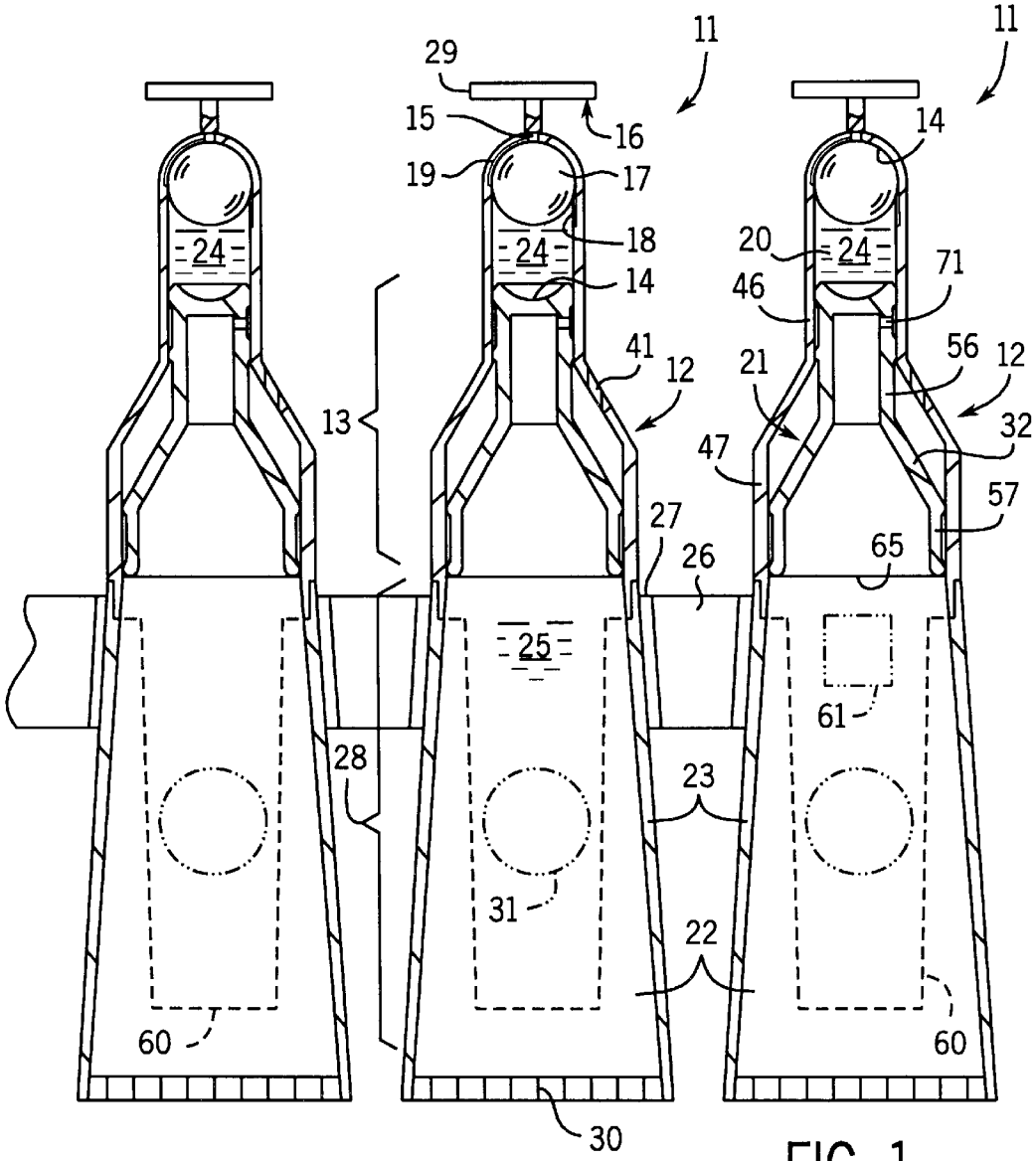
FIG. 1 A part sectional side view of a packaging unit containing several dispensers.

FIG. 1 shows a row of several juxtaposed, interconnected, identical dispensers 11. Said dispensers are disposable dosing means constructed as pump atomizers. In each case they have a base part 12 forming a casing, which like all the other parts of the dispenser can be made from a plastic injection moulding. An offset, cylindrical pump cylinder unit 13 of the base part 12 forms on one side a medium chamber 20, terminated at its end by an end face 14. The latter centrally contains an outlet port 15 forming a nozzle and which is closed by a moulded on break-off closure 16. This break-off closure is subsequently provided at the outlet port in the end wall 14 with a connecting piece injection moulded together with the base part 12 and which is injection moulded by means of a very thin wall tightly closing the outlet port around said outlet port. A gripping disk 29 permits the manual opening of the outlet port by twisting off said break-off closure 16.

Into the cylinder section 13 is pressed a spherical insert 17 extending up to the spherical segmental end wall 12. Together with the wall of the base part it defines flow channels 18. Through grooves running along the end wall are formed spiral whirl channels 19, which are connected to the flow channel 18. A liquid flowing through the flow channel is subject to a whirling action through the whirl channels 19 and ensures at the nozzle-like outlet port 15 a fine atomization in an atomizing cone.

The pump cylinder unit 13 is constructed in two stages and has a smaller diameter discharge cylinder 46 closer to the outlet port 15 and a much larger diameter drive cylinder 47 connected thereto. The diameter difference is preferably 1:1.5 to 1:4 and the pressure change produced in accordance with the shape factor can be approximately two to sixteen times. In the same is guided a plunger 21, which has a plunger section 56 inserted into the narrower discharge cylinder 46 and which is connected by means of a conical shaft section 32 to a larger diameter plunger sleeve or collar 57, which sealingly engages on the inner wall of the pump cylinder section 47. The plunger is cup-shaped and hollow, the inner opening being directed away from the medium chamber in order not to impede a complete discharge of the medium 24 contained therein.

The plunger surface facing the insert is adapted for the same reason to the insert shape, i.e. it is spherical segmental. The plunger 21 can be made from a flexible plastic, optionally a rubbery material, and has on the outside a few circumferential ribs or sealing lips, which guide it in relatively firmly seated, tight manner in the pump cylinders. It tightly seals the medium chamber 20 and ensures that the medium therein, e.g. a pharmaceutically active liquid, is sealed against all external influences.

Figure 2:
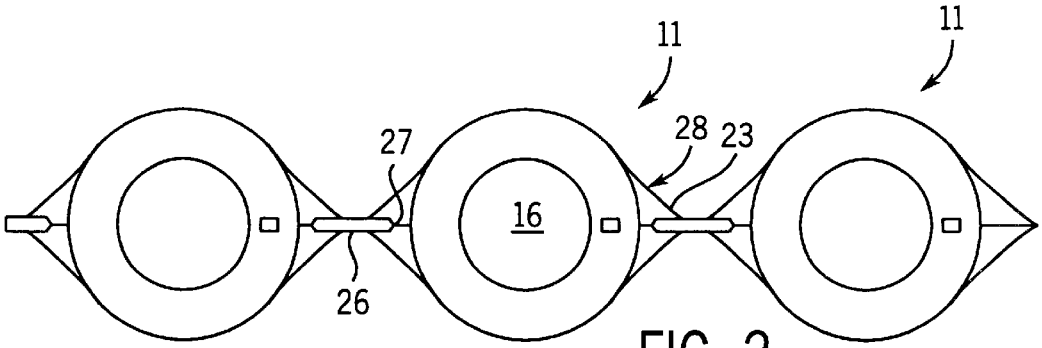
FIG. 2 A partial plan view of the dispensers according to FIG. 1.

The pressure chamber section 28 of the base part 12 connected to the cylinder unit 13 is, as shown in FIG. 2 in cross-section increasingly elliptical towards its end and has a smaller thickness than the pressure chamber wall 23. It terminates a pressure chamber 22, which is filled with a pressure fluid 25, e.g. water. The volume of the pressure chamber 22 is somewhat greater than the volume of the medium chamber 20 to be discharged. At the side opposite to the discharge port the pressure chamber 22 is sealed by a straight weld or sealing seam 30 similar to a tube closure of seal. As stated, although the cylinder and pressure chamber sections 13, 28 are injection moulded in one piece, they result from a two-component injection moulding process using plastics having different characteristics (cylinder and medium chamber more rigid and pressure chamber softer). The plastics form an integral joint, so that the base part is in one piece.

FIG. 1 shows in broken line form that the more shape-stable plastic can also form web-like reinforcing elements 60 in the pressure chamber section 28 and which pass from the cylinder unit 13 to close to the terminating weld. They are provided on the flattest sides of the elliptical pressure chamber wall and as a result of their greater rigidity ensure a distribution of the compressive force applied by two fingers. The left-hand dispenser in FIG. 1 reveals in dot-dash line form a window 61 in the reinforcing element 60, which makes its connection to the cylinder unit more flexible and in hinge-like form. This can also be brought about by bending points having a reduced material thickness. The reinforcing elements also produced by two-component injection moulding are interconnected by the flexible wall elements 23 in the manner of a bellows.

The dispenser 11 is interconnected with neighbouring dispensers by means of a connecting web 26, which is connected to the base part by means of a predetermined breaking point. All the base parts of a row of juxtaposed dispensers 11 are jointly manufactured in one piece by plastic injection moulding and remain in this form, optionally separated into a smaller number of dispensers per packaging unit compared with the manufacturing state up to the final consumer.

For manufacture and filling the unit formed by the juxtaposed dispenser base parts 12 is initially provided with the insert 17. The medium 24 is then filled into the medium chamber and the plunger 21 is inserted in the pump cylinder section 13.

The pressure chamber 22 is then filled with the pressure fluid 25. As the latter, if it is a liquid, has no function other than the application of a hydraulic pressure, it can be a random liquid and for ease purposes it is usually water. In accordance with the conditions it is also possible to use other liquids or additives therein, e.g. for frost protection purposes. All the pressure chambers are then tightly sealed by welding closed at the weld 30. This gives a magazine of several juxtaposed dispensers which, each in its own right, are completely tightly sealed.

For use purpose the consumer can in each case separate one of the outer dispensers of the magazine, by destroying the predetermined breaking point 27 by bending backwards and forwards. Firstly the user removes the break-off closure, so that the outlet port 15 is freed. The discharge nozzle can also be sealed by a tear-off foil or film. He then presses with two fingers on the correspondingly marked pressure areas 31 of the pressure chamber and consequently places the pressure fluid 25 under pressure. This pressure acts on the much larger active drive plunger face 65 of the plunger 21 at the bottom in FIG. 1 and drives it upwards after overcoming a static friction adhesion action, so that the medium 24 builds up a corresponding pressure in the medium chamber 20. The medium can flow through the flow channel 18 and whirl channels 19 to the outlet port, where it is atomized. The much smaller discharge plunger face 14 of the discharge plunger part 56 consequently produces a correspondingly higher pressure in the medium chamber 20.

A hole 41 in the area between the cylinders prevents a compression of air enclosed between them during operation. The movement of the plunger 21 starts only after building up a sufficient pressure in the pressure chamber and consequently the medium chamber. If the friction of the plunger in the pump cylinder 13 is not sufficient to build up an adequately high initial pressure, it would be possible to provide in the cylinder wall e.g. a projection or a slight circumferential bead, which ensures an adequate restraint. However, normally the static friction is sufficient, which is greater than the sliding friction during the pump stroke because after the start of the plunger movement the medium can under certain circumstances act as a plunger lubrication.

It is pointed out that in this way the liquid contained in the medium chamber 20 can be completely discharged except for the small volumes of channels 18, 19.

The dispenser only comprises three plastic parts (base part 12, insert 17 and plunger 21). They can be formed from plastics of a comparable type and can consequently be reprocessed in type-pure manner. The pressure fluid, which can usually be water, is not prejudicial.

The right-hand dispenser in FIG. 1 has a lateral hole 71 in the discharge plunger section 56, which connects the plunger interior and consequently the pressure chamber to the plunger outside at a point between two sealing lips. If the upper sealing lip closer to the insert has passed over the channel 18 projecting in the medium chamber 20 towards the end of the discharge stroke, the pressure fluid 25, e.g. air can flow out of the nozzle and consequently entrain and discharge the final medium residues. This permits a complete utilization of the in certain circumstances very expensive medium. The user also notes through the decreasing counterpressure that the discharge stroke is ended.

Figure 3:
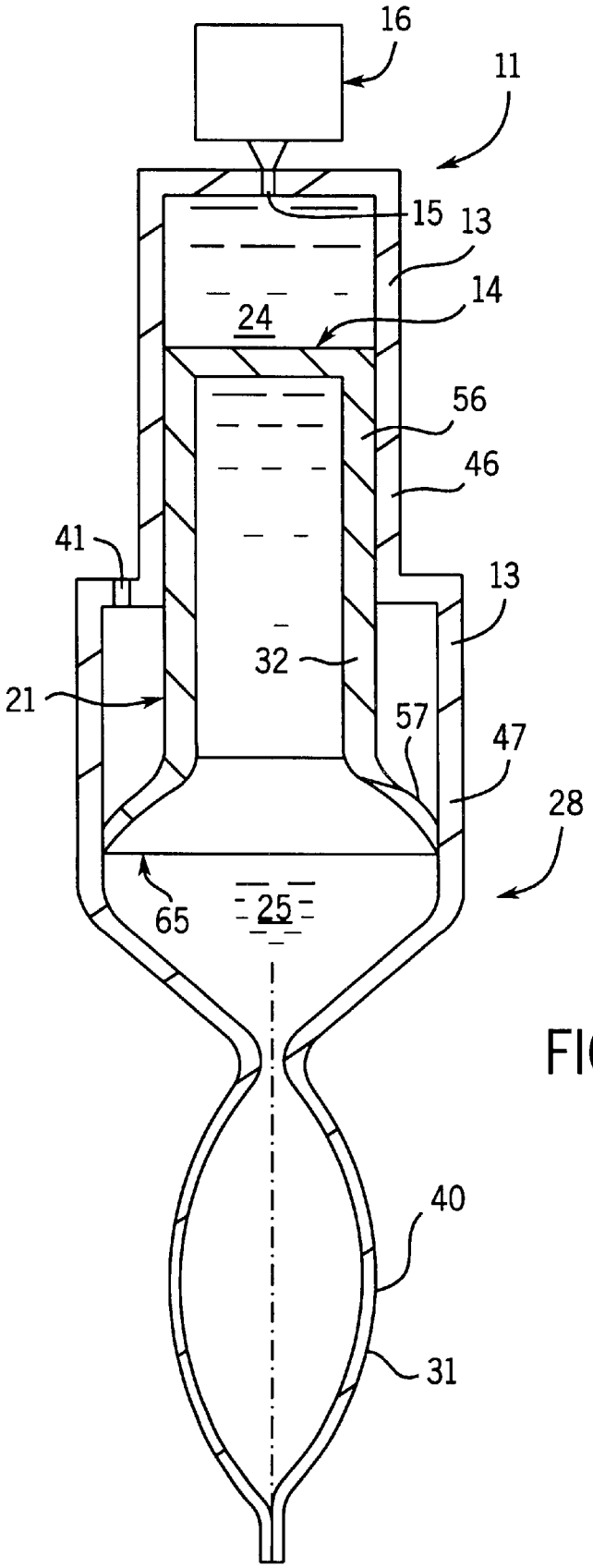
FIG. 3 An axial section through another embodiment of the dispenser.

With an otherwise identical and here not again described construction and operation compared with FIGS. 1 and 2, the embodiment according to FIG. 3 has the following differences.

The pressure chamber section 28, which is connected to the pump cylinder section 13, is shaped in the manner of a tube jacket or a hot water bottle, i.e. it has a lateral circumferential seam or similarly constructed flat point and in its faces two convex, e.g. spherical segmental bulges 40. The material is elastic, but still shape-stable, so that it reacts in "spring catch-like manner", i.e. in the case of a pressure over a dead centre snaps in the opposite convexity. The pressure chamber section 28 is also filled with the pressure fluid 25.

The manufacture and filling are as the FIGS. 1 and 2. For operation purposes the user presses on the convex wall 40 of the pressure chamber section 28, so that the latter snaps round on one side and is placed flat in the corresponding cavity on the other side. Thus, after overcoming this pressure point produced by the "spring catch characteristic" of the pressure chamber section, the pressure fluid 25 is placed under a corresponding pressure and moves the plunger unit 21 of FIG. 3 upwards. As a result of the much larger area of this plunger section 57 compared with the area 14 of the plunger section 56 in the medium chamber zone, the force is increased in accordance with the shape factors and the medium is discharged with an increased pressure from the nozzle 15. The air can escape from the area above the drive plunger section 57 through a vent hole 41.

What is claimed is:

1. Dispenser for flowable media (24) comprising:

a cylinder unit (13) having a discharge cylinder (46) and a drive cylinder (47);

a medium chamber (20) containing the medium;

an outlet port (15) from the medium chamber, the discharge cylinder (46) being connected to the medium chamber;

a pressure chamber (22) filled with a pressure fluid (25) and being connected to the drive cylinder (47);

a plunger unit (21) for discharging the medium (24) performing an operating stroke in the cylinder unit (13) placed between the medium chamber (20) and the pressure chamber;

the plunger (21) unit being displaced by means for manually pressurizing the pressure fluid (25) acting on a drive plunger face (65) of the plunger unit;

the drive cylinder (47) having a larger active cylinder surface than that of the discharge cylinder (46) and the plunger unit being constructed in the manner of a stepped plunger, whose discharge plunger face (14) facing the medium chamber (20) has a much smaller area than the drive plunger face (65), the outlet port (15) being constructed as a whirling nozzle comprising whirl channels (19), which are shaped in an inner end wall (14) of the medium chamber (24) and are bounded by a medium chamber insert.

2. Dispenser according to claim 1, wherein the pressure chamber (22) is compressible in an operating part of said pressure chamber located outside the drive cylinder.

3. Dispenser according to claim 1, wherein, in inoperative state, the plunger unit (21) comprises means providing a predetermined restraint with respect to the plunger unit running resistance during the operating stroke.

4. Dispenser according to claim 1, wherein the pressure fluid is compressible.

5. Dispenser according to claim 1, wherein the plunger unit (21) comprises a connecting channel, connecting the pressure chamber (22) with the outlet port (15) at the end (13, 44) of the plunger's operating stroke.

6. Dispenser according to claim 1, wherein the medium chamber insert is a ball.

7. Dispenser according to claim 1, wherein the pressure chamber (22) is partly constructed in the manner of a squeezing container.

8. Dispenser for flowable media (24) comprising:

a cylinder unit (13) having a discharge cylinder (46) and a drive cylinder (47);

a medium chamber (20) containing the medium;

an outlet port (15) from the medium chamber, the discharge cylinder (46) being connected to the medium chamber;

a pressure chamber (22) filled with a pressure fluid (25) and being connected to the drive cylinder (47);

a plunger unit (21) for discharging the medium (24) performing an operating stroke in the cylinder unit (13) placed between the medium chamber (20) and the pressure chamber;

the plunger (21) unit being displaced by means for manually pressurizing the pressure fluid (25) acting on a drive plunger face (65) of the plunger unit;

the drive cylinder (47) having a larger active cylinder surface than that of the discharge cylinder (46) and the plunger unit being constructed in the manner of a stepped plunger, whose discharge plunger face (14) facing the medium chamber (20) has a much smaller area than the drive plunger face (65), the pressure chamber (22) being provided with a snap action device.

9. Dispenser according to claim 8, wherein the snap action device is formed by a curved wall construction (40) of an elastic pressure chamber wall.

10. Dispenser according to claim 8, wherein the pressure chamber (22), medium chamber (20) and the discharge and drive cylinder (46, 47) are formed as a one-piece plastic moulding, produced in a two-component injection moulding process from plastic materials of different characteristics.

11. Dispenser according to claim 8, wherein the pressure chamber has a flat weld (30) at its end.

12. Dispenser according to claim 8, wherein the dispenser is constructed as a disposable dispenser comprises a base part (12) forming the medium and pressure chambers (20, 22) and the cylinder unit (44, 46), connected to at least one adjacent dispenser (11) by a connecting section (26) containing a predetermined breaking point (27).

13. Dispenser according to claim 8, wherein the outlet port (15) is closed by a break-off closure (16) before use.

14. Dispenser according to claim 8, wherein the outlet port is a spray nozzle.

15. Dispenser for flowable media (24) comprising:

a cylinder unit (13) having a discharge cylinder (46) and a drive cylinder (47);

a medium chamber (20) containing the medium;

an outlet port (15) from the medium chamber, the discharge cylinder (46) being connected to the medium chamber;

a pressure chamber (22) filled with a pressure fluid (25) and being connected to the drive cylinder (47);

a plunger unit (21) for discharging the medium (24) performing an operating stroke in the cylinder unit (13) placed between the medium chamber (20) and the pressure chamber;

the plunger (21) unit being displaced by means for manually pressurizing the pressure fluid (25) acting on a drive plunger face (65) of the plunger unit;

the drive cylinder (47) having a larger active cylinder surface than that of the discharge cylinder (46) and the plunger unit being constructed in the manner of a stepped plunger, whose discharge plunger face (14) facing the medium chamber (20) has a much smaller area than the drive plunger face (65), the medium chamber (20) and the cylinder unit (30) being made from a more shape-stable plastics material and the wall (23) of an operating part (28) of the pressure chamber (22) at least partly from a more flexible plastics material, reinforcing elements (49) made of the more shape-stable material running along the operating part (28) and being interconnected by wall sections of the more flexible material.

16. Dispenser according to claim 15, wherein between the reinforcing elements and the cylinder unit (46, 47) the reinforcing elements are constructed with a reduced cross-section for forming a hinge-like bending point.

* * * * *